US005481788A

United States Patent [19]

Simon et al.

[11] Patent Number: 5,481,788

[45] Date of Patent: Jan. 9, 1996

[54] APPARATUS FOR PRODUCING WELDING ROD

[76] Inventors: R. E. Simon, 603 Boulder Cir., Dayton, Nev. 89403; L. E. Mann, 4222 Dant Blvd., Reno, Nev. 89509

[21] Appl. No.: 201,371

[22] Filed: Feb. 24, 1994

[51] Int. Cl.[6] ..... B21C 43/02

[52] U.S. Cl. ..... 29/81.13; 29/650; 29/81.01; 72/274; 53/111 RC; 53/430; 204/129.35

[58] Field of Search ..... 29/81.01, 527.7, 29/33 F, 33 R, 81.04, 81.03, 81.13, 650; 53/430, 111 RC; 72/40, 274; 204/129.35

[56] References Cited

U.S. PATENT DOCUMENTS

| | | | |
|---|---|---|---|
| 2,005,902 | 6/1935 | Mathias | 29/81.01 |
| 2,239,044 | 4/1941 | Leighton | 29/81.01 |
| 3,225,508 | 12/1965 | Simon | 53/432 |
| 3,498,094 | 3/1970 | Simon | 72/38 |
| 4,063,346 | 12/1977 | Simpson et al. | 29/527.7 |
| 4,290,823 | 9/1981 | Dompas | 164/476 |
| 4,354,880 | 10/1982 | Adams et al. | 164/476 |
| 5,311,655 | 5/1994 | Jager et al. | 164/495 |

FOREIGN PATENT DOCUMENTS

| | | | |
|---|---|---|---|
| 245913 | 11/1986 | Japan | 29/527.7 |

*Primary Examiner*—David P. Bryant
*Attorney, Agent, or Firm*—Herbert C. Schulze

[57] ABSTRACT

A method and apparatus for producing high quality welding rod including a first forming of an ingot under vacuum forming techniques; a continuous mechanical de-scaling at all stages, including, but not limited to, final drawing; an unusual electrolytic purification process, and a final controlled packaging process.

1 Claim, 2 Drawing Sheets

APPARATUS FOR PRODUCING WELDING ROD

REFERENCE TO RELATED PATENT APPLICATION

This patent application is not related to any other patent application filed by us.

BACKGROUND OF THE INVENTION

1. Field of the Invention

This invention is in the general field of welding rods;

The invention is more particularly related to an improved method and apparatus for forming a welding rod of unusual and superior quality.

2. Description of the Prior Art

The prior art in this field is primarily found in U.S. Pat. No. 3,225,508 and 3,498,094.The present invention relates to an unusual combination of steps incorporating some of the steps previously used in practicing the two referenced patents.

SUMMARY OF THE INVENTION

Particularly in the area of high-tech welding, and most particularly in connection with sensitive welding, such as in aircraft, and the like, the quality of welding rod (also referred to as "wire" "electrodes" and the like, as is known to those skilled in the art) must be superior and free of contaminants.

The previously mentioned United States patents addressed the production of superior welding rods, and controlling the contaminants therein.

We have now conceived and perfected a unique method and apparatus for producing most superior quality welding rod with virtually no contaminants.

Fundamentally, we have developed a multi-staged method, and the apparatus to perform the method, by which we produce very superior welding rod.

We accomplish this by constant attention to physical removal of any and all scale and surface impurities at all stages.

We commence with the purest ingots formed by a double vacuum process. This consists of melting by vacuum induction plus vacuum arc remelt. After the ingot is formed, we take a sample slice and analyze this. If the ingot appears of generally satisfactory quality, we then completely machine the exterior surfaces removing all scale or other surface imperfections.

At all stages of the cogging (the physical working of billets), the otherwise conventional preheat and reheat temperatures are more carefully controlled than in other processes known to us. Ends of billets are constantly cropped rather than customary occasional cropping as indicated by ultrasonic inspection. All de-scaling is by mechanical means to avoid introduction of gasses, or other impurities.

Before the final actual drawing of the wire or rod, the normal process involves annealing and pickling of the redraw rod. This forms an intentionally rough surface to retain lubricant for the wire drawing. In our method, we remove surface oxides at this stage by seam free turning (physical removal of surface oxides). The redraw rod is polished in our method to achieve a completely smooth surface before the wire forming process. We do not use lubricants in the drawing.

In the usual wire drawing process the forces are tangential to the wire. We use a process in which the forces are perpendicular, or non-tangential. We draw, using rollers normal to the direction of travel, in compression, as opposed to, tension, which is customary in other processes. Thus we eliminate the shear forces which produce minute tears or scratches on the surface of the wire, thus providing a plethora of possibilities of surface contamination.

We now go to a critical stage. We have perfected a method, and apparatus, for electrolytic cleaning of the wire (rod). This is described in the following description of a preferred embodiment. At this phase, the wire is given the ultimate cleansing.

We have developed a unique electrolytic cleansing system which is finally used to remove any possible contaminants.

The final step of our highly controlled system is the controlled packaging we use. The spools of wire (or packages of rods) are enclosed, with proper identifying information, in vapor barrier packages with adequate desiccants. Additionally, means are provided for air evacuation and/or introduction of inert gases.

An object of this invention is to provide a method and apparatus for producing high quality welding rod;

Another object of this invention is to provide contaminant-free welding rod;

Another object of this invention is to provide electrolytic cleansing of welding rod.

The foregoing, and other, objects and advantages of this invention will be understood by those skilled in the art by a review of the following description of a preferred embodiment in conjunction with a review of the appended drawings.

DESCRIPTION OF A PREFERRED EMBODIMENT

Figure 1:
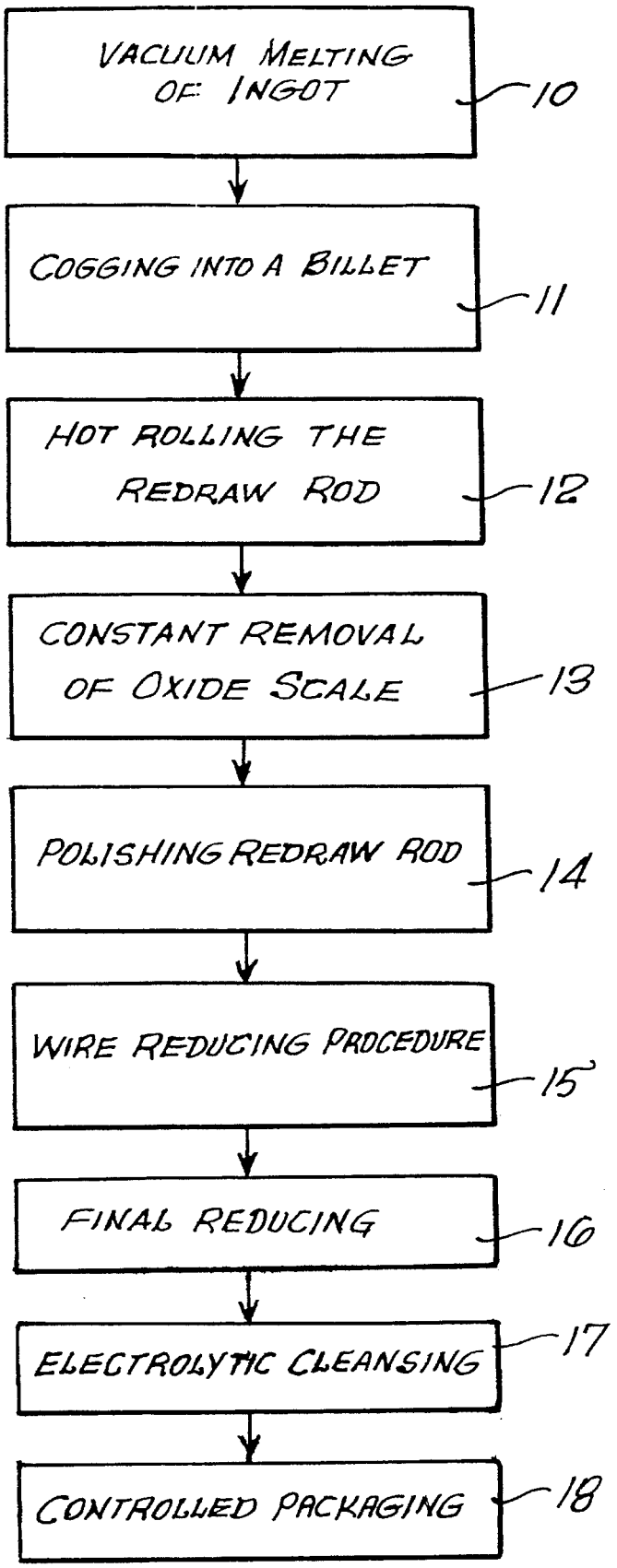
FIG. 1 is a block diagram illustrating the various phases and Operations involved in this method.

FIG. 1 shows the entire method of this invention. Some of the steps are conventional - but not necessarily conventional in order nor in practice. The uniqueness of the method will be apparent to those skilled in the art.

At block diagram position 10 the ingots are formed by vacuum melting and there is an unusual, but important, mechanical scale removal by machining, rather than customary chemical treatment ; at position 11 cogging is performed, but with mechanical de-scaling; at position 12 the hot rolled redraw bar, or billet is subjected to seam free turning to remove surface oxides; at position 13 there is mentioned the continuous physical removal of oxide scale by machining; at position 14 there is the important, and normally, in the past, not performed, polishing of the rod; at position 15 the wire reducing procedure is performed; at position 16 there is the final wire pass in the wire reducing process and polishing; at position 17 there is the unique electrolytic cleansing operation; and, at 18 is the controlled packaging.

Figure 2:
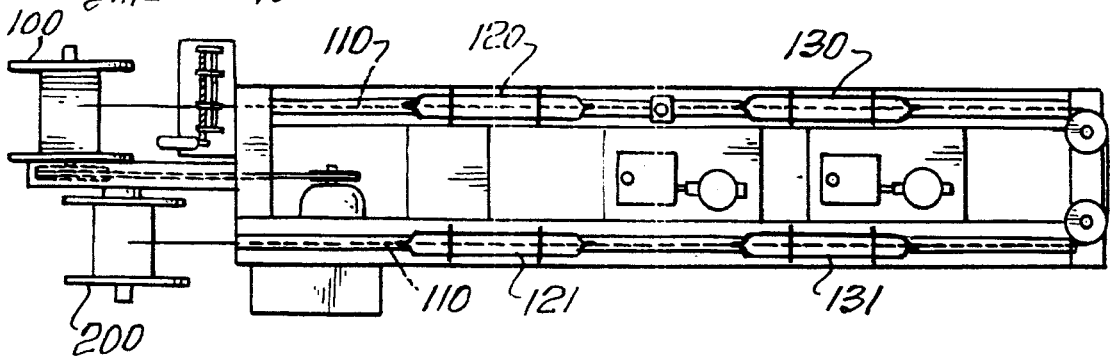
FIG. 2 is a schematic top elevation view of the electrolytic final cleaning operation.
Figure 3:
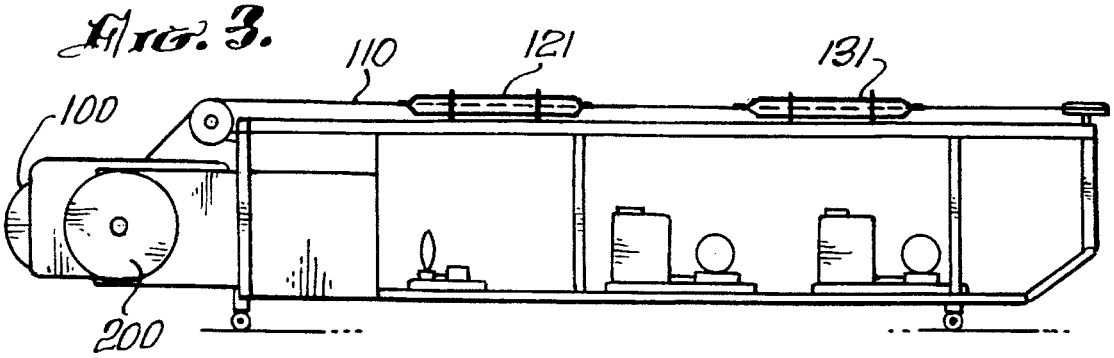
FIG. 3 is a side elevation view of the mechanism of FIG. 2.

FIGS. 2 and 3 show the unique electrolytic cleansing mechanism. The final take up spool is at 100. The initial spool is at 200. The wire 110 feeds from spool 200 through first electrolytic chamber 121 to second electrolytic chamber 131, then to power spray rinse 130 and finally to high pressure air drying chamber 120.

After passing through all of these stages, the wire 110 is wound on to the final take up spool 100. At this point the spool is either packaged with desiccant, as previously mentioned, or is cut into rods and packaged in a like manner.

Figure 4:
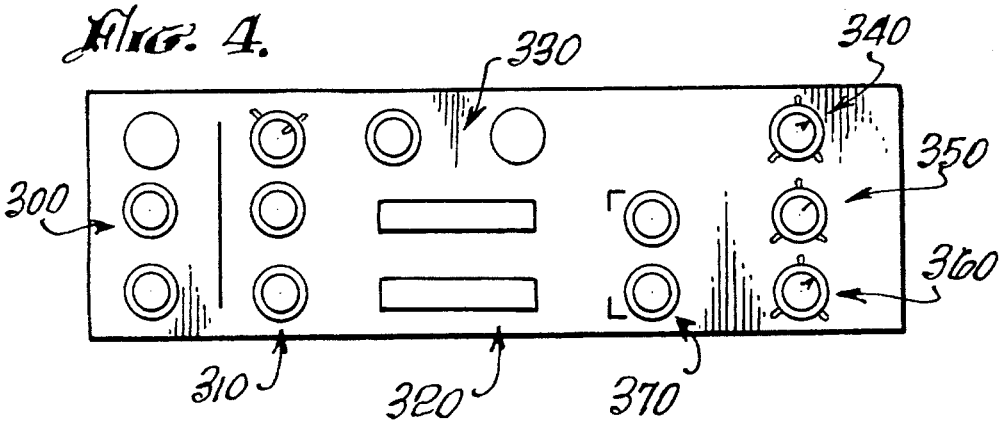
FIG. 4 is a front elevation of a control panel utilized in the apparatus of FIGS. 2 and 3.

A unique control panel has, also, been developed by us to accomplish our overall method. This is shown in FIG. 4. The power indication and activation is at 300. The automatic system activation and condition is shown at 310. The electrical condition is shown at 320. The reset controls are at 370. Tension, traverse rate, and wire speed are indicated at 340, 350, and 360 respectively.

While the embodiments of this invention as shown and described are fully capable of achieving the objects and advantages of this invention, such embodiments are for purposes of illustration, only, and not for purposes of limitation.

We claim:

1. Apparatus for producing welding wire comprising, in cooperative relationship: means for double vacuum forming of ingots; means to machine the outer surface of the ingots; means for cogging redraw bars from the ingots including ultrasonic inspection means and cropping means; seam free turning means to remove oxides from the redraw bars; means to polish the redraw bars; means to draw the redraw bars by compression to form reduced-diameter welding wire; means for electrolytic cleansing of the wire; and means for controlled packaging of the wire.

* * * * *